US007654023B2

(12) United States Patent
Peters et al.

(10) Patent No.: US 7,654,023 B2
(45) Date of Patent: Feb. 2, 2010

(54) BACKLIT STATIC DISPLAY ON FOAM BOARD USING LIGHT PIPING PEGS AS HIGHLIGHTERS

(76) Inventors: Mark Peters, 312 Crownview Ct., Sa Marcos, CA (US) 92069; Lisa Peters, 312 Crownview Ct., San Marcos, CA (US) 92069

( * ) Notice: Subject to any disclaimer, the term of this patent is extended or adjusted under 35 U.S.C. 154(b) by 296 days.

(21) Appl. No.: 11/103,740

(22) Filed: Apr. 11, 2005

(65) Prior Publication Data

US 2006/0225327 A1 Oct. 12, 2006

(51) Int. Cl.
*G09F 13/00* (2006.01)

(52) U.S. Cl. ..... 40/547; 40/564; 446/118; 446/219

(58) Field of Classification Search ..... 40/547, 40/546, 622, 619, 564, 575; 446/219, 118, 446/125; 362/249.14, 581
See application file for complete search history.

(56) References Cited

U.S. PATENT DOCUMENTS

| | | | | | |
|---|---|---|---|---|---|
| 1,226,550 | A * | 5/1917 | McNeal | 40/579 |
| 2,125,403 | A * | 8/1938 | Slutsky | 40/579 |
| 2,145,747 | A * | 1/1939 | Askew | 40/406 |
| 2,429,379 | A * | 10/1947 | Swain | 40/579 |
| 2,837,836 | A * | 6/1958 | Morawitz | 273/282.1 |
| 3,631,474 | A * | 12/1971 | Majewski | 340/815.55 |
| 3,780,695 | A * | 12/1973 | Richard | 116/202 |
| 4,196,539 | A * | 4/1980 | Speers | 446/75 |
| 4,276,705 | A * | 7/1981 | Barth et al. | 40/579 |
| 4,477,193 | A | 10/1984 | Yasufuku | |
| 5,121,926 | A * | 6/1992 | Pfaender | 273/236 |
| 5,247,600 | A * | 9/1993 | Williams et al. | 385/115 |
| 5,324,224 | A | 6/1994 | Anderson | |
| 5,391,105 | A * | 2/1995 | Jones | 446/219 |
| 5,398,170 | A * | 3/1995 | Lee | 362/559 |
| 5,588,235 | A * | 12/1996 | Juchymenko et al. | 40/547 |
| 5,636,914 | A | 6/1997 | Trusiani | |
| 5,704,789 | A * | 1/1998 | Yang | 434/96 |
| 6,027,343 | A | 2/2000 | Ho | |
| 6,032,393 | A | 3/2000 | Maxim | |
| 6,068,486 | A | 5/2000 | Frank et al. | |
| 6,238,261 | B1 * | 5/2001 | Lang | 446/219 |
| 6,539,824 | B2 * | 4/2003 | Wedhorn | 81/25 |
| 6,729,932 | B2 * | 5/2004 | Jarvis | 446/219 |
| 7,214,118 | B1 * | 5/2007 | Maxim | 446/118 |
| 2003/0179577 | A1 * | 9/2003 | Marsh | 362/260 |
| 2006/0123678 | A1 * | 6/2006 | Arvin | 40/547 |

* cited by examiner

*Primary Examiner*—William L. Miller
(74) *Attorney, Agent, or Firm*—Jerry T. Kearns

(57) ABSTRACT

A display for displaying an image to a viewer, capable of highlighting specific locations selected by a user. This display comprises:

a) a punchable layer such as a foam board having a first surface and a second surface, b) an image affixed to the first surface of the punchable layer. The punchable layer and the image form a sandwich dubbed display cover which is partially transparent and is observed by a viewer located on the image side of the display cover, c) a light source illuminating the second surface of the punchable layer, d) a piercing means for enabling the user to punch at least one hole into the punchable layer, and e) a plurality of pegs equal in number to the number of holes. The pegs are longer than the thickness of the display cover and furthermore are significantly more translucent than the display cover, such that when inserted into the holes by the user, they operate as light pipes and channel light generated by the light source, across the display cover, and scatter light toward the viewer, thereby allowing the pegs to operate as highlighters over the lesser illuminated display cover.

32 Claims, 10 Drawing Sheets

BACKLIT STATIC DISPLAY ON FOAM BOARD USING LIGHT PIPING PEGS AS HIGHLIGHTERS

FIELD OF THE INVENTION

The present invention relates to light displays, more precisely, back-lit static slide displays in which most of the display is opaque or slightly translucent, while small selected areas are made extremely luminous by the insertion of translucent pegs that act as light pipes and allow the back light to channel through them, making them highly visible.

BACKGROUND

Backlit static displays are well known devices that have been used in a wide diversity of applications. These devices, which typically comprise a translucent slide placed in front of a light source, provide a uniform rendition of the image on the slide. While useful, devices as described in the prior art do not offer the opportunity for highlighting locations of interest by allowing the user or viewer to increase or decrease at will the transparency of the slide at those locations.

A device capable of displaying a backlit image with a controllable degree of transparency is described in U.S. Pat. No. 6,032,393. It comprises a peg board mounted in front of a polarized light source. The peg board is a rectangular array of equally spaced holes into which translucent pegs can be inserted. The distribution of pegs in the array and their orientation with respect the angle of polarization can give rise to interesting colored light patterns. These patterns however, are limited to the discrete combinations of peg placements in the regularly spaced holes. In addition, this device does not give the user the opportunity to superimpose an image on the light pattern generated by the pegs.

Further features, aspects, and advantages of the present invention over the prior art will be more fully understood when considered with respect to the following detailed description claims and accompanying drawings.

SUMMARY OF THE INVENTION

Figure 1:
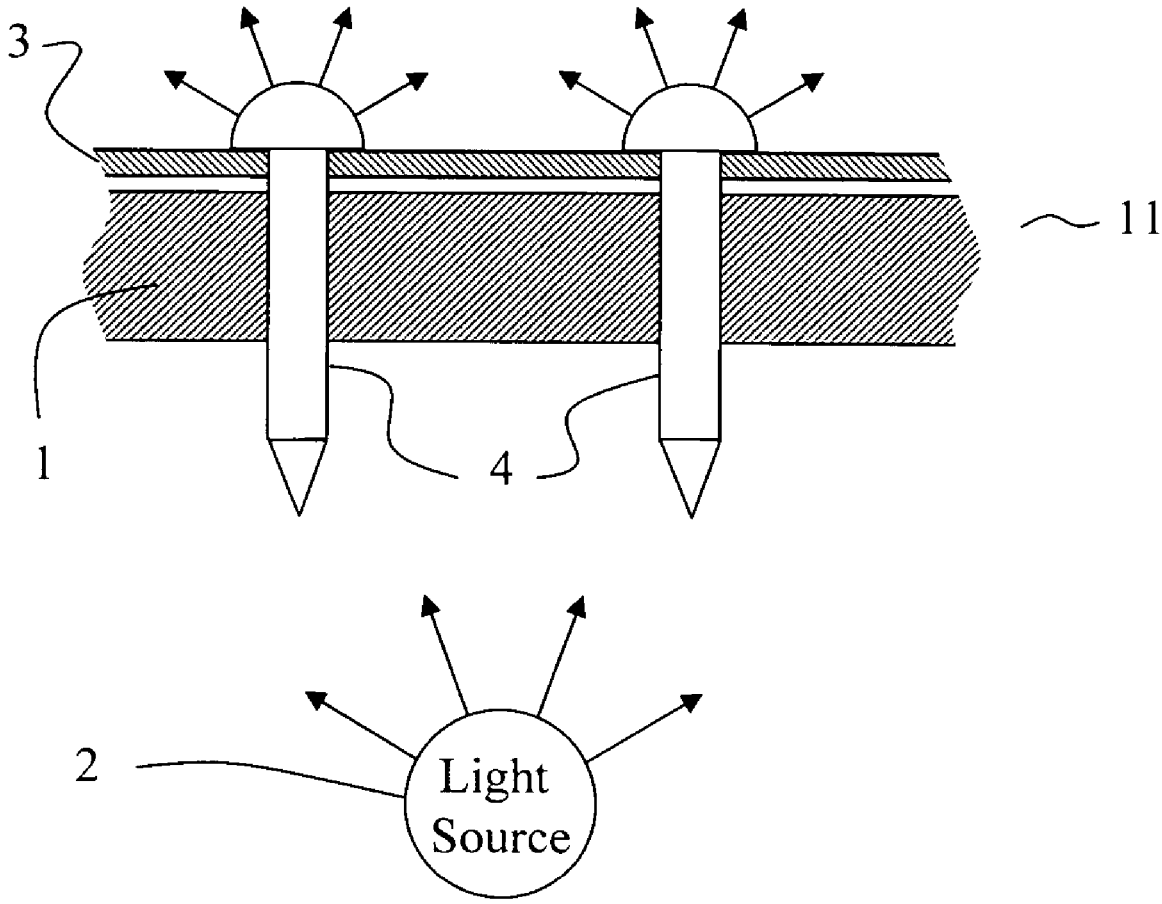
FIG. 1 illustrates the basic concept of this invention which comprises a foam-board like layer covered with an image on one side, illuminated on the other side, and traversed by translucent pegs operating as light pipes which scatter light and are used to highlight portions of the image.

A display for presenting an image to a viewer, capable of highlighting specific locations selected by a user. This display comprises:

a) a punchable layer such as a foam board having a first surface and a second surface, b) an image affixed to the first surface of the punchable layer. The punchable layer and the image form a sandwich dubbed display cover which is partially transparent and is observed by a viewer located on the image side of the display cover, c) a light source illuminating the second surface of the punchable layer, d) a piercing means for enabling the user to punch at least one hole into the punchable layer, and e) a plurality of pegs equal in number to the number of holes. The pegs are longer than the thickness of the display cover and furthermore are significantly more translucent than the display cover, such that when inserted through the display cover, they operate as light pipes. They channel light generated by the light source, across the display cover, and scatter light toward the viewer, thereby allowing the pegs to operate as highlighters.

A variation includes enclosing the light source in a box into which the punchable layer and image sandwich can be slidably inserted. Another variation includes enclosing a light box in a box equipped with poles that fit into matching holes in the foam and image sandwich to hold the punchable layer and image sandwich in place. Yet another variation includes enclosing the light into a box hinged to a frame that holds the foam board and image sandwich in place. Yet a further variation includes a box permanently affixed to the foam and image sandwich. Yet one more variation comprises a punchable layer and image layer sandwich equipped with suction cups attachable to a window pane. Yet a further variation includes the punchable layer and image layer sandwich equipped with suction cups for attachment to smooth transparent surfaces such as window panes.

DETAILED DESCRIPTION

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various figures are designated by the same reference numerals.

FIG. 1 illustrates the basic concept in this invention. A layer 1 of "punchable" material such as a foam board is placed above a source of light 2 which shall be referred to as a back light. The definition of "punchable" layer shall be provided in the next paragraph. An image layer 3 is positioned on top of the punchable layer 1. The image can be, for example, printed on a thin sheet made, for instance, of paper or plastic. Optionally the image can be laminated to give it extra strength. The image can be affixed to the punchable layer by means of glue or clamps or can simply be printed directly on top of the punchable layer.

The layer of punchable material is firm and does not sag, yet soft and crunchable enough to be punched through by a sharp object such as a pin, nail or a pointed peg 4. Furthermore, after being punched through by such a sharp object, it should have the property of holding the object in place. A foam board or the like fulfills these requirements because of its mechanical properties. In the remainder of this application, the sandwich comprised of punchable layer 1 and the image 3 shall be referred to as the display cover 11 and the sharp object 4 shall be referred to as a peg.

The punchable layer and image layer that constitute the display cover can be assembled at the time of manufacture and thus be permanently configured.

Alternatively, the punchable layer and image layer can be separate and be assembled at a later time for example by a salesman or by the user. The image layer can take the form of pre-printed labels which can be provided in advance to the user, to guide him in his activities, be they related to his business, his artistic endeavors or his playful occupation.

Another requirement of this invention is that the pegs 4 be significantly more transparent or translucent than the display cover to allow them to operate as light pipes and channel the back light across the display cover when they are punched through it.

Figure 2:
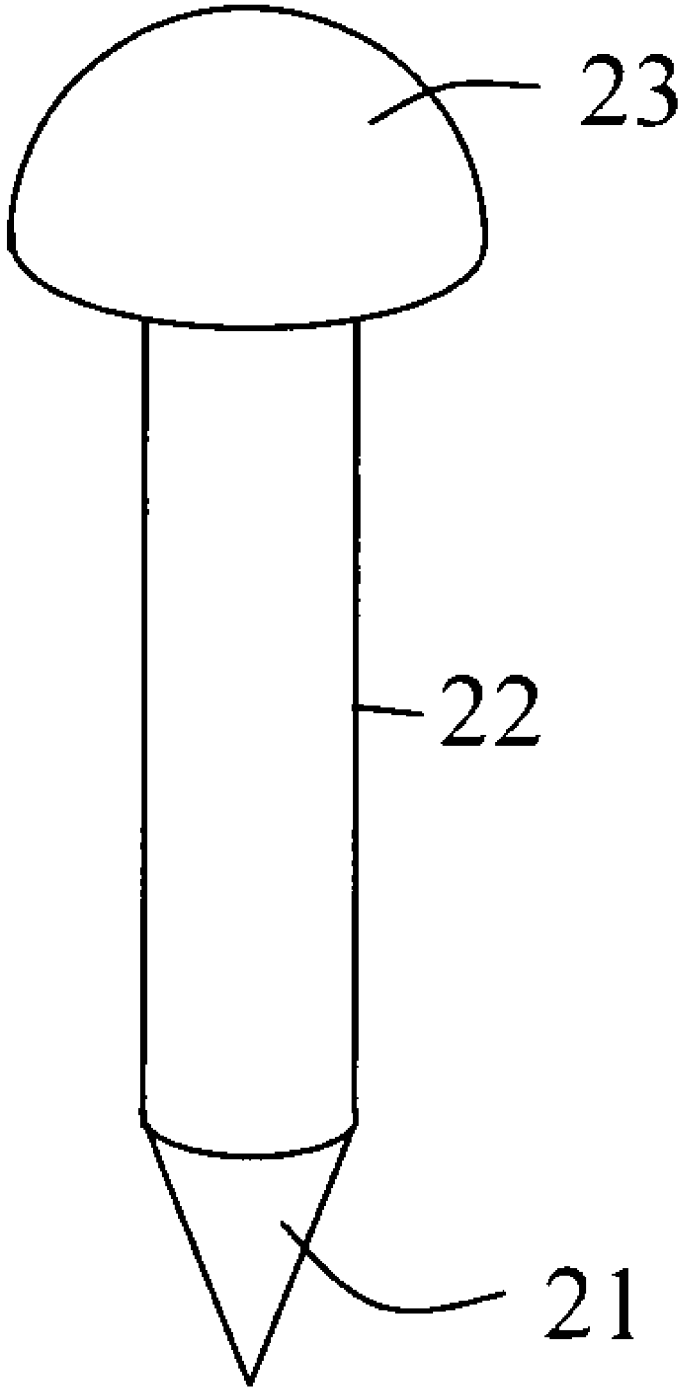
FIG. 2 shows a peg as a cylindrical body equipped with a pointed end and a wide domed top.

Pegs should be made of a material translucent to light such as acrylic or styrene and their shape should be designed to maximize the capture and scatter light. FIG. 2 describes such a peg. The pointed end 21 of a peg allows its penetration of the display cover 11; its lower cylindrical body 22 maximizes the exposure to the back light; and its wide and rounded dome-shaped top 23 maximizes its visibility by scattering light over a wide angle as well as provide a stop to the penetration of the peg into the punchable layer. The top surface of the peg can be smooth or can be frosted or rough to increase the scattering of light. The length of a peg can vary in size, but it was found to work best when it is approximately ¾" long to allow it to completely penetrate the punchable layer and capture light on the other side.

Figure 3:
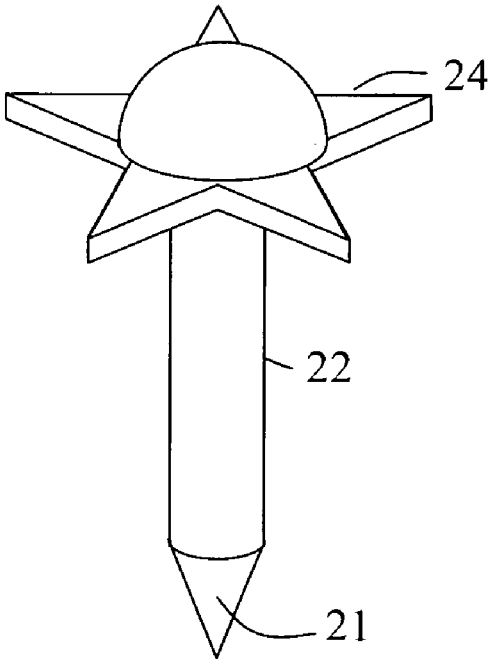
FIG. 3 shows a peg as a cylindrical body equipped with a pointed end and a domed head surrounded by a star shape.
Figure 3A:
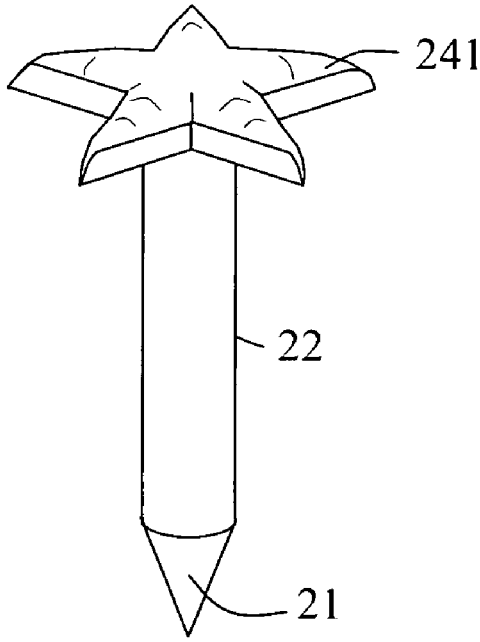
FIG. 3*a* illustrates a peg as a cylindrical body equipped with a pointed end and a head shaped like a star with a rounded top, star-shaped domed head.

In addition, pegs can be made in different colors, thereby filtering the white back light to provide highlighting colors. Using colored pegs enable the user to employ different highlights for different locations of interest on the display. In addition, as illustrated in FIG. 3 and FIG. 3*a* the top of pegs can be made in different shapes such as round 23, or star-shaped 24, or to represent animals, faces, cars, or to symbolize corporate logos, etc.

A further variation of pegs is that they can be made opaque to allow a user to fill existing holes to block the light from coming through a hole made in the display cover by accident or otherwise, thereby restoring the display cover to its original opacity before the holes were punched. Such opaque pegs shall be called plugs in this invention.

Figure 4:
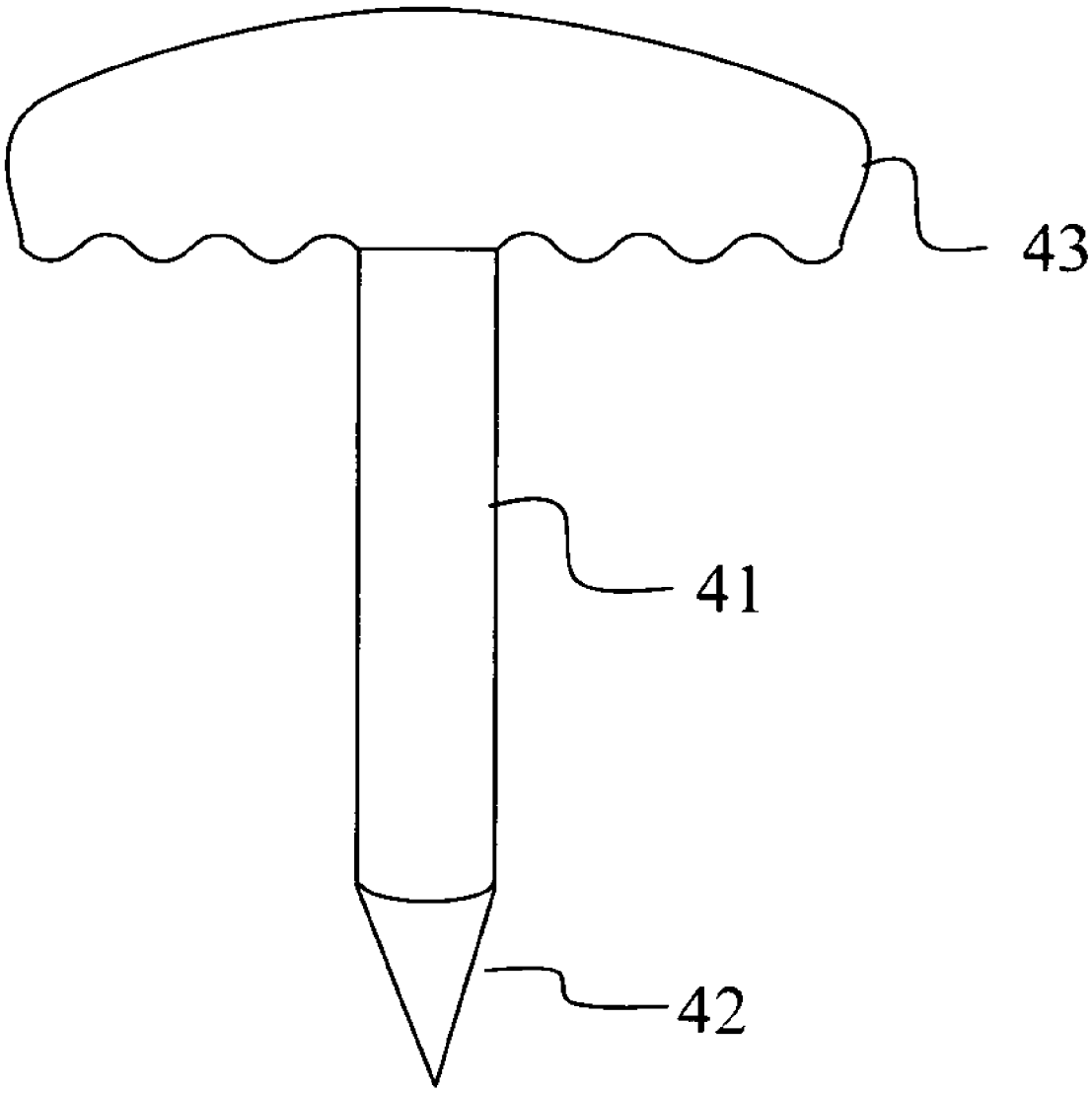
FIG. 4 illustrates a piercing tool.

Yet another variation of pegs is that the display function and piercing functions can be implemented in two different objects. In other words, a special piercing tool could be provided, having a shape more convenient for handling. As shown in FIG. 4 this tool comprises a shaft 41 pointed at one end 42 and attached at the other end to a handle 43.

While the pegs are characterized by a high translucency, the display cover 11 can be given a lesser degree of translucency than the pegs or made completely opaque. A partially translucent display can be advantageous when backlighting of the image is desired such as in a dark environment.

The punchable layer 1 can be made of foam board or any other material with similar mechanical properties. The foam board can have a thickness of ⅛", ¼" ⅜", ½" etc, depending on the degree of translucency desired. Some translucency may be desirable to make the display self illuminating and more visible in a dark environment.

The image layer 3 can be laminated to provide more durability. It can be simply deposited on the punchable layer or affixed by means of glue or clamps. It can also be embodied by a simple layer of ink or pigment printed directly on the punchable layer.

Figure 5:
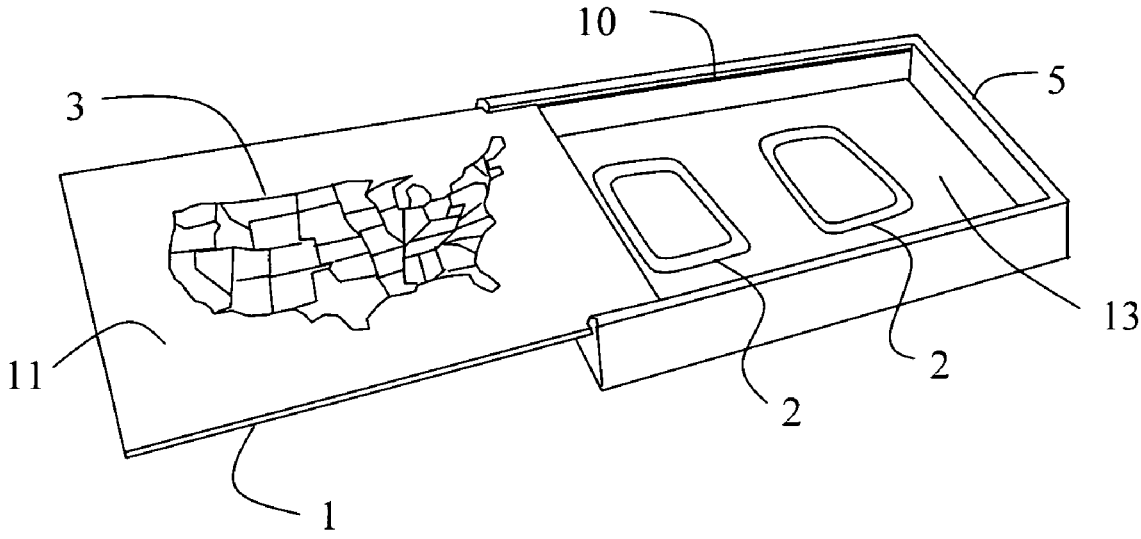
FIG. 5 describes how the invention can be embodied as a box holding a light source and configured with grooves such as to accept a slidably inserted foam-board and image sandwich.

Several variations of this basic idea are illustrated in FIG. 5 through 8. In these figures, the image layer 3 is represented by a map of the United States. FIG. 5 shows how the back light 2 can be implemented by means of fluorescent tubes held in place within a light box 5. Not shown in the figure but implicitly included, are the ballasts driving the fluorescent lights. For a display having an area of about four square feet, the total wattage required for the two fluorescent lights shown in FIG. 2 is approximately between 44 and 64 watts. Clearly if more luminosity is required more powerful lamps could be used. While fluorescent lighting has the advantage of producing little heat, this invention is not restricted to the use of fluorescent light but could also work with other lighting systems such as incandescent light bulbs or Light Emitting Diodes (LEDs.)

The light box 5 can be made of plastic, wood or metal and is lined with a reflective material 13 such as aluminum sheets, Mylar® or silver paint to minimize the heat absorption of the box and maximize the illumination available to the display. The display cover 11 is slidedly inserted into grooves 10 located on the inner sides of the light box. This feature allows for the easy replacement of a display cover 11 by another, or the easy disassembly of a display cover and the replacement of the image layer.

Although the box in FIG. 5 is rectangular in shape, other shapes could be used such as square, circles, ovals, etc.

Figure 6:
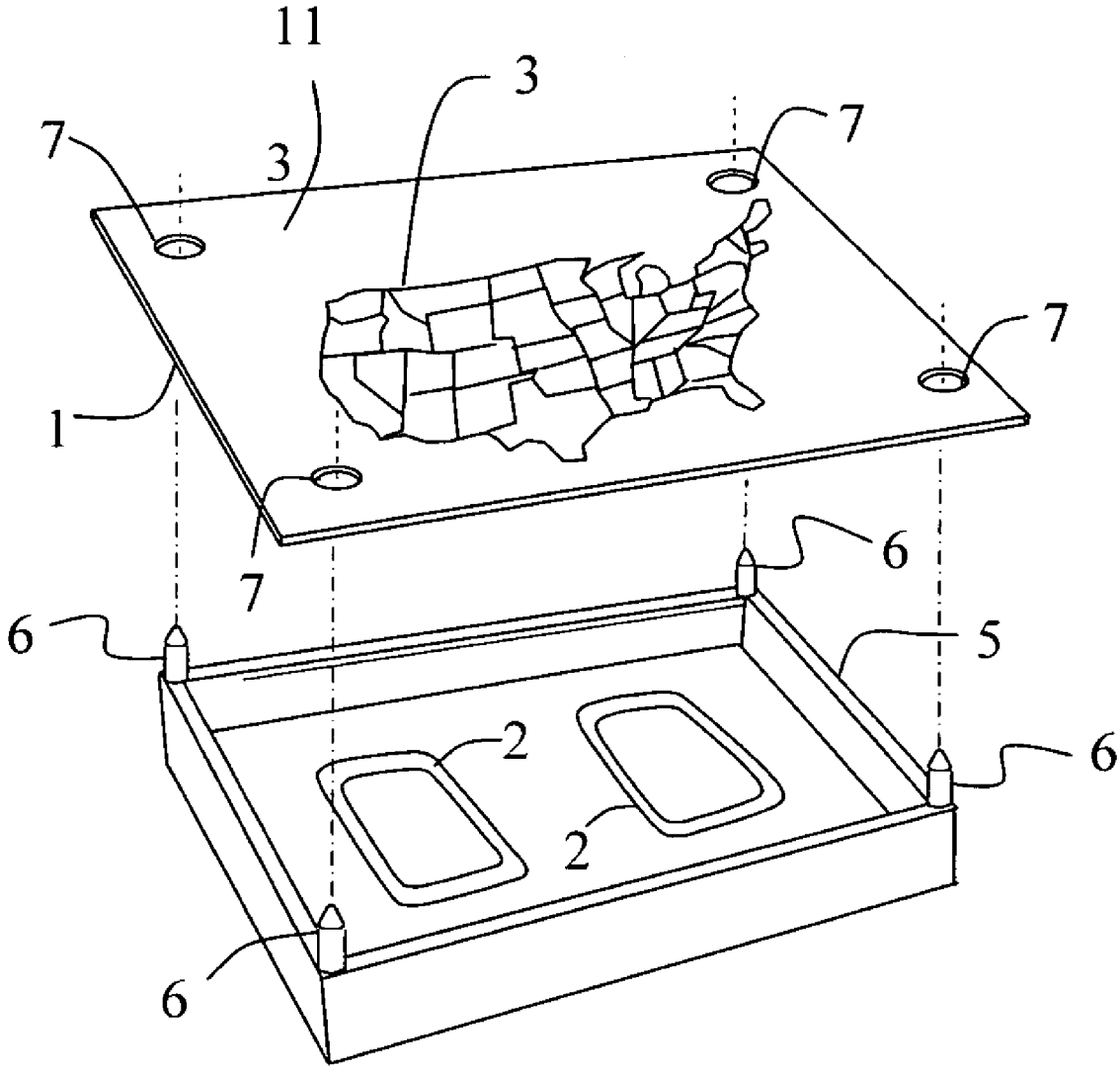
FIG. 6 shows how the invention can be embodied as a box holding a light source and equipped with poles on its perimeter such as to accept a foam-board and image sandwich equipped with holes matching the poles in configuration.

Another example is shown in FIG. 6. In this case the light box 5, instead of holding the display cover 11 by means of grooves 10, holds it by means of poles 6 located at the corner of the light box 5. The display cover 11 is equipped with a number of holes 7 matching in position the position of the poles 6.

Figure 7:
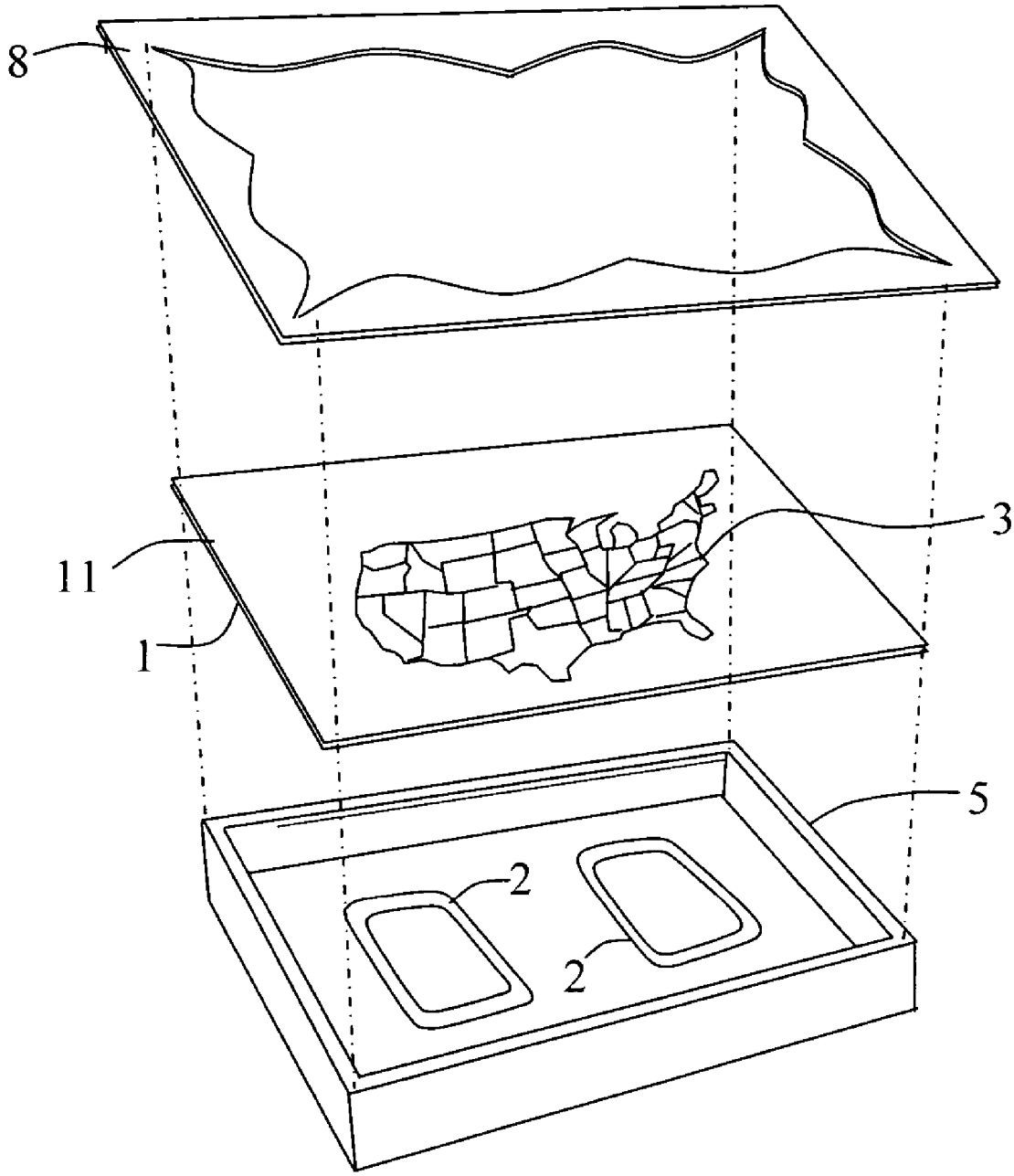
FIG. 7 shows that the invention can be embodied as a box holding a light source. A frame is used to hold down the foam-board and image sandwich. The frame has the purpose of holding in place the display cover, and can also improve the artistic presentation of the display.

Yet one more variation is shown in FIG. 7. The display cover is held in place by a frame attached to the light box. While the frame is shown to be rectangular in the drawing, it does not have to be so, and can assume any desired shape including but not restricted to circular, oval, square triangular, and polygonal. The frame can be attached to the light box by various means such as screws, clasps, Velcro™, snaps etc. The frame may also include the hardware required to hang the whole assembly on the wall.

Figure 7A:
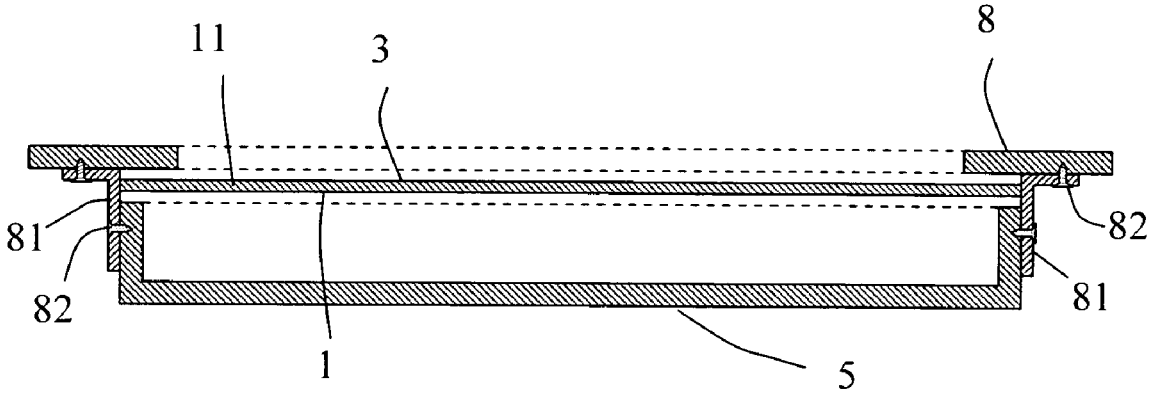
FIG. 7*a* provides a cross section view of the box assembly with display cover covered with a frame which is attached on the box by means of L-shaped brackets and screws.

FIG. 7*a* provides a cross section view of the box assembly 5 with display cover 11 covered with a frame 8. The frame 8 can be attached on the box 5 by means of L-shaped brackets 81 and screws 82.

Figure 8:
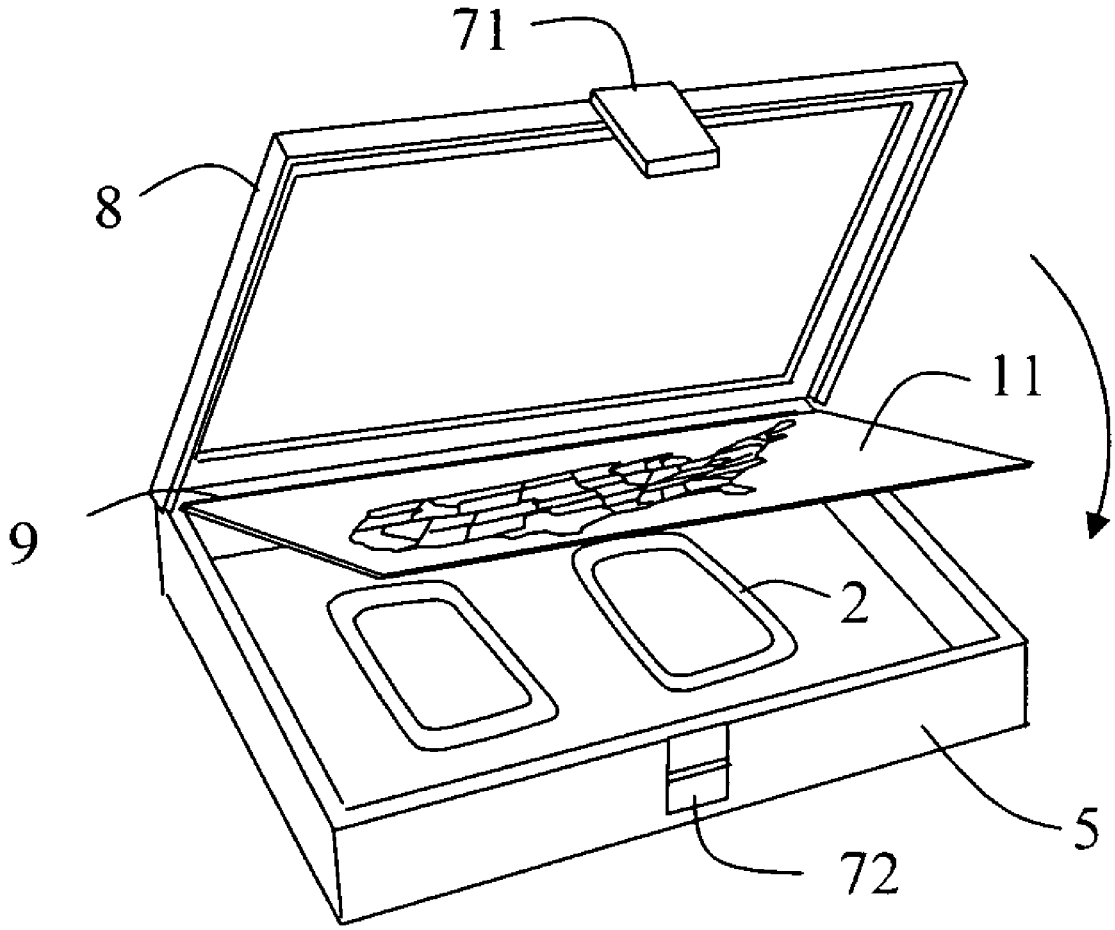
FIG. 8 illustrates how the invention can be embodied as a box holding a light source with the box hinged to a frame that holds in place a foam-board and image sandwich.

Yet another example is illustrated in FIG. 8. In this case, the display cover is held in place by a rectangular frame 8 articulated to the light box 5 by means of a hinge 9. On the hinge side, the frame must conform to, or be part of, the hinge 9. A possible option is to include with the frame a closing mechanism or latch to maintain the frame tightly closed against the display cover. In FIG. 8, the first side of the latch 71 is attached to the frame 8 and the second side of the latch 72 is attached to the light box 5.

Figure 9:
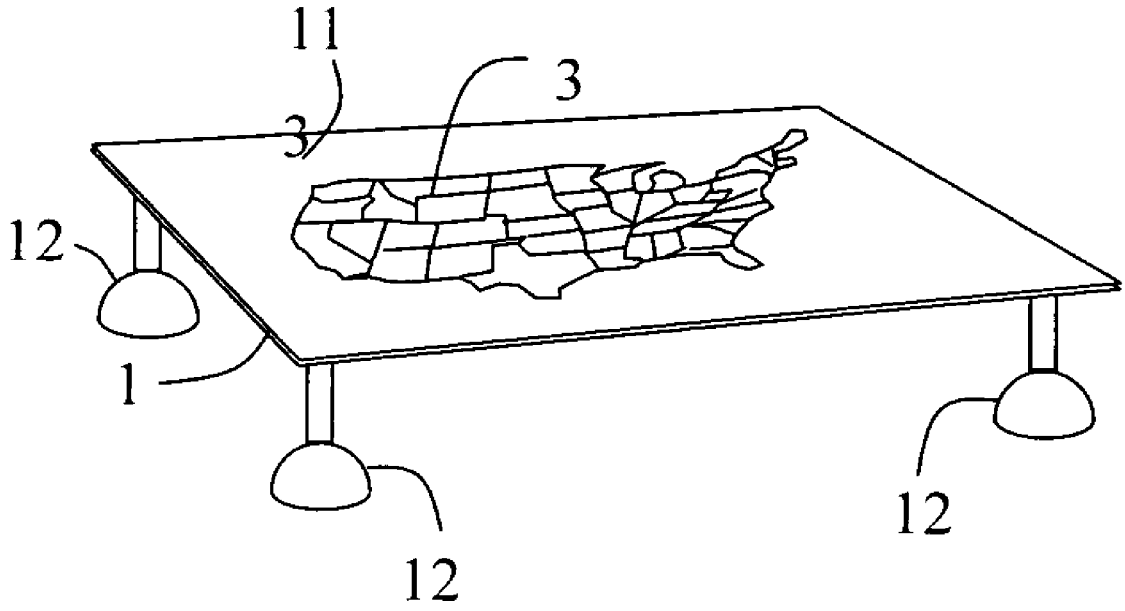
FIG. 9 shows how an invention can be embodied as a foam board and image sandwich equipped with suction cups.

Yet a further example is shown in FIG. 9. In this example, the display is mounted on a window or such a transparent support, by means of suction cups. The display makes use of light generated from a natural source such as the sun, or by an artificial source not part of this device, such as a fixture mounted on a wall. As described in the FIG. 9, the display cover 11 is equipped with suction cups 12 capable of being affixed to a flat and smooth surface such as a window pane.

Applications of this invention include

1. Map display. The user can highlight areas of interest (for example cities, geological or mineralogical formation, historical sites, etc) by placing pegs at those locations on the map.
2. Child growth chart. Parents and child can track the progress of a child by placing pegs on the chart at locations corresponding to the height or to any other growth characteristics of the child.
3. Educational Tool. Teachers could use maps lit by means of pegs as described above to highlight geographical or historical locations of interest.
4. Child School Performance Chart. Teacher, parent and students can track the student performance in school or any other school-related or extra-curricular activities such as sports, by placing pegs on the appropriate locations on the chart.
5. Child Behavior Monitor Chart. Parent can highlight a child's behavior at home such as keeping a record of chores done (or chores to be done) by placing pegs in appropriate locations in a behavior chart.
6. Toy or Artistic Medium. This display can be used as a toy or as an artistic medium to inscribe in light any pattern of interest.
7. Business advertisement. Companies can publicize several geographical locations where their stores, offices or places of business are located by displaying maps wherein those locations are highlighted as described herein.
8. Company Logos. Companies could display their logos in light by positioning pegs appropriately on a display board.
9. Military Maps. The military could use this invention to represent inexpensively on a battlefield, objects such as friendly forces, cities, bridges, factories and enemy target location and forces.

While the above description contains many specificities, the reader should not construe these as limitations on the scope of the invention, but merely as exemplifications of preferred embodiments thereof. Those skilled in the art will envision many other possible variations within its scope. Accordingly, the reader is requested to determine the scope of the invention by the appended claims and their legal equivalents, and not by the examples which have been given.

The invention claimed is:

1. A display for displaying an image to a viewer, capable of highlighting specific locations selected by a user comprising:

a) a punchable layer comprising a non-opaque foam board having a first surface and a second surface and furthermore having a predetermined amount of translucency;

b) an image layer secured in close conforming overlying sandwiched relation to said first surface of said punchable layer, said image layer being non-opaque and having a predetermined amount of translucency, said punchable layer and said image layer forming a non-opaque display cover, said display cover having a first degree of translucency determined by the combined translucency of said punchable layer and the translucency of said image layer;

c) a back light source illuminating said second surface of said punchable layer and backlighting said translucent image layer;

d) a plurality of holes punched through said image layer and into said punchable layer, a plurality of non-opaque pegs equal in number to the number of said holes, said pegs having a length greater than the thickness of said display cover and furthermore having a second degree of translucency, said second degree of translucency being significantly higher than said first degree of translucency of said display cover, such that when said pegs are received within said holes in said punchable layer said punchable layer retains and supports said pegs, said pegs operate as light pipes and channel light generated by said light source, through said image layer of said display cover, and scatter light toward said viewer, thereby allowing said pegs to operate as highlighters over the lesser illuminated translucent image layer of said display cover; and e) at least one piercing means for enabling said user to punch said holes through said image layer and into said punchable layer, wherein said at least one piercing means is selected from the group consisting of a pointed end of at least one of said pegs or a piercing tool having a pointed end.

2. A display as in claim 1 wherein said pegs are made of material of different colors thereby allowing said user to apply to said image, illuminating highlights of different colors.

3. A display as in claim 1 wherein said pegs are comprised essentially of an elongated body having a bottom end and a top end, said bottom end being said pointed end and thereby embodying said piercing means, and said top end being wide and dome shaped, thereby enabling the scattering of light and providing a stop to the penetration of said pegs into said holes.

4. A display as in claim 3 wherein said pegs are frosted on said top end.

5. A display as in claim 3 wherein said top end of said pegs are given shapes selected from a set of basic configurations enabling said user to apply highlights of different shapes to said image.

6. A display as in claim 5 wherein said basic configurations comprise shapes selected from the group consisting of alphanumerical characters, punctuation symbols, animals, plants, faces, automobiles, planes, cartoon characters, stars, moons, suns, geometrical figures, musical symbols, and corporate logos.

7. A display as in claim 1 also comprising plugs, said plugs having the same general shapes as said pegs, said plugs being opaque, such that when inserted into said holes by said user said plugs block light from coming through a hole made in the display cover.

8. A display as in claim 1 wherein said piercing means is embodied as said piercing tool comprised of a shaft having said pointed end and attached to a handle at the other end.

9. A display as in claim 1 wherein said backlight comprises at least one fluorescent light.

10. A display as in claim 1 wherein said back light is produced by a lamp enclosed in a box, said box comprised of a bottom and a wall around the perimeter of said bottom, and furthermore having an open top of a predetermined shape over which said display cover can be mounted.

11. A display as in claim 10 wherein said predetermined shape of said open top is selected from the set consisting of square, rectangle, circle, oval, trapeze, and diamond.

12. A display as in claim 10 wherein at least one of said bottom and said top is lined with a reflecting layer.

13. A display as in claim 10 wherein said display cover is slidedly inserted into said box.

14. A display as in claim 10 wherein said box carries around its perimeter a number of poles in a predetermined configuration and said display cover carries within its perimeter a number of holes in a configuration identical to said predetermined configuration of said poles, said holes being slightly larger than said poles, allowing said display cover to be lowered over said box and held in place by said poles.

15. A display as in claim 10 comprising a frame having an inner edge and an outer edge, said inner edge being approximately parallel with, following and overlapping the perimeter of the open top of said box such that said frame holds in place said display cover against said box.

16. A display as in claim 15 wherein said frame is used to hold said display cover in place.

17. A display as in claim 16 wherein said frame is hingedly attached along one edge of said box, such that when said frame is in a hingedly open position said display cover can be placed over, or removed from, said box, and when said frame is in a hingedly closed position, said frame holds said display cover in place.

18. A display as in claim 17 comprising a closing mechanism for attaching said frame to said box.

19. A display as in claim 10 wherein said display cover is affixed to said box.

20. A display as in claim 1 comprising of hardware suitable to hold said display on a wall.

21. A display as in claim 1 wherein said display cover is equipped with suction cups capable of attachment to a glass pane and said light source is located behind said glass pane.

22. A display as in claim 21 wherein light source is natural.

23. A display as in claim 1 wherein said image is a map.

24. A display as in claim 1 wherein said image is a child growth chart.

25. A display as in claim 1 wherein said image is an educational tool.

26. A display as in claim 1 wherein said image is a child school activity performance chart.

27. A display as in claim 1 wherein said image is a child behavior monitor chart.

28. A display as in claim 1 is employed as a toy to compose images.

29. A display as in claim 1 is employed as an artistic medium.

30. A display as in claim 1 is employed to publicize geographical locations of a business.

31. A display as in claim 1 is employed to display a company logo by positioning pegs in the configuration of said logo.

32. A display as in claim 1 is employed to publicize geographical locations of a business.

* * * * *